US006910274B1

(12) United States Patent
Pennella et al.

(10) Patent No.: US 6,910,274 B1
(45) Date of Patent: Jun. 28, 2005

(54) SHAVING APPARATUS

(75) Inventors: Andrew Pennella, Stamford, CT (US); Kenneth A. Raymond, Bethany, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 10/737,002

(22) Filed: Dec. 16, 2003

(51) Int. Cl.[7] ..... B26B 21/44
(52) U.S. Cl. ..... 30/41; 30/535
(58) Field of Search ..... 30/41, 41.5, 123, 30/535, 538, 34.05; 222/191

(56) References Cited

U.S. PATENT DOCUMENTS

| | | | | |
|---|---|---|---|---|
| 1,899,841 A | | 2/1933 | Acken | 30/41 |
| 2,686,361 A | * | 8/1954 | Resnick et al. | 30/41 |
| 2,839,224 A | * | 6/1958 | Lipka | 222/191 |
| 2,866,265 A | * | 12/1958 | Kells | 30/41 |
| 3,053,422 A | | 9/1962 | Tenison | 222/399 |
| 3,417,468 A | * | 12/1968 | Miyauchi | 30/41 |
| 3,703,765 A | | 11/1972 | Perez | 30/41 |
| 3,726,009 A | | 4/1973 | Hackmeyer | 30/41 |
| 4,023,269 A | | 5/1977 | Lopez, Jr. | 30/41 |
| 4,077,119 A | | 3/1978 | Sellera | 30/41 |
| 4,177,556 A | | 12/1979 | Galli, Jr. | 30/41 |
| 4,377,034 A | | 3/1983 | Druash et al. | 30/41 |
| 4,433,483 A | | 2/1984 | Lazarus | 30/41 |
| 4,562,643 A | | 1/1986 | Cataudella | 30/41 |
| 4,753,006 A | | 6/1988 | Howe | 30/41 |
| 4,760,642 A | | 8/1988 | Kwak | 30/123 |
| 4,791,723 A | | 12/1988 | Jacobson | 30/41 |
| 4,809,432 A | | 3/1989 | Schauble | 30/41 |
| 4,813,138 A | | 3/1989 | Chen | 30/41 |
| 4,868,982 A | | 9/1989 | McComas | 30/41 |
| 4,888,868 A | | 12/1989 | Pritchard | 30/41 |
| 4,908,945 A | | 3/1990 | Jacobson | 30/41 |
| 4,974,319 A | | 12/1990 | Maguire, Jr. et al. | 30/41 |
| 5,014,427 A | | 5/1991 | Byrne | 30/41 |
| 5,016,351 A | | 5/1991 | Drahus | 30/41 |
| 5,092,041 A | | 3/1992 | Podolsky | 30/41 |

(Continued)

FOREIGN PATENT DOCUMENTS

FR 2 634 154 * 1/1990

(Continued)

OTHER PUBLICATIONS

Copy of PCT Search Report for Serial No. PCT/IB03/01144 dated Oct. 29, 2003.

*Primary Examiner*—Hwei-Siu Payer
(74) *Attorney, Agent, or Firm*—Michaud Duffy Group LLP

(57) ABSTRACT

According to the present invention, a shaving apparatus handle includes an interior cavity, a housing, and an actuator. The interior cavity has a first end and a second end lengthwise, and is operable to store flowable shaving aid material. The housing is mounted on the handle and includes one or more ports in fluid communication with the contents of the interior cavity. The actuator is disposed within the interior cavity and includes a ratchet mechanism, a button, and a piston. The ratchet mechanism and the button are operable to work in concert to move the piston uni-directionally toward the second end of the interior cavity. The movement of the piston causes the flowable shaving aid material to be dispensed from the handle adjacent a razor cartridge.

22 Claims, 3 Drawing Sheets

U.S. PATENT DOCUMENTS

| | | | | | |
|---|---|---|---|---|---|
| 5,103,560 | A | | 4/1992 | Podolsky | 30/41 |
| 5,168,628 | A | | 12/1992 | Mock et al. | 30/41 |
| 5,234,140 | A | | 8/1993 | Demarest et al. | 222/394 |
| 5,241,751 | A | * | 9/1993 | Goh | 30/41.5 |
| 5,384,961 | A | | 1/1995 | Gregory | 30/41 |
| 5,564,190 | A | | 10/1996 | Fleetwood | 30/41 |
| 5,673,485 | A | | 10/1997 | Hill | 30/41.5 |
| 5,701,674 | A | | 12/1997 | Mitchell | 30/41 |
| 5,761,813 | A | | 6/1998 | Frick et al. | 30/41 |
| 5,855,066 | A | | 1/1999 | Manger | 30/41 |
| 5,983,500 | A | | 11/1999 | da Silva | 30/41 |
| 6,754,958 | B2 | * | 6/2004 | Haws et al. | 30/41 |
| 6,789,321 | B2 | * | 9/2004 | Simms | 30/41 |

FOREIGN PATENT DOCUMENTS

| | | |
|---|---|---|
| GB | 2 246 314 A | 1/1992 |
| JP | 10-165668 | 6/1998 |
| JP | 2003210874 | 7/2003 |
| WO | WO 00/10780 | 3/2000 |
| WO | WO 00/47374 | 8/2000 |
| WO | WO 02/32253 A1 | 4/2002 |

* cited by examiner

SHAVING APPARATUS

BACKGROUND OF THE INVENTION

1. Technical Field

The present invention relates to shaving apparatus in general, and to shaving apparatus having a mechanism for providing a flowable shaving aid material in particular.

2. Background Information

Numerous attempts have been made to combine a razor assembly with a mechanism for dispensing shaving aid material. Some prior art devices (e.g., U.S. Pat. Nos. 3,726,009 and 1,899,841) disclose a reservoir disposed in the handle of the device for storing shaving aid material. The shaving aid material is propelled from the reservoir to the head of the device through one or more passages extending therebetween. A problem with providing a reservoir within the handle is that it is often necessary to make the handle uncomfortably large to accommodate a desirable amount of shaving aid material. If the handle is kept to a reasonable size, the volume of shaving aid material provided is undesirably small. Another problem with a shaving device having a reservoir containing a liquid or gel material is leakage.

Therefore, it is desirable to provide a shaving apparatus that overcomes these known shortcomings in the prior art.

DISCLOSURE OF THE INVENTION

According to the present invention, a shaving apparatus includes a handle and a housing. The handle includes an actuator and an interior cavity having a first end and a second end lengthwise, the interior cavity being operable to store flowable shaving aid material. The housing includes one or more ports in fluid communication with at least a portion of the interior cavity. The housing is mounted on the handle. The actuator is disposed within the interior cavity and includes a ratchet mechanism mounted between the first and second ends of the interior cavity, a button disposed between the ratchet mechanism and the first end of the interior cavity, a piston, and a button spring. The piston includes a piston head coupled to a piston body. The button spring is disposed between the button and the ratcheting mechanism and is operable to bias the button towards the first end of the interior cavity. The ratchet mechanism and the button are operable to move the piston toward the second end of the interior cavity through a series of distinct positions, thereby decreasing the volume of the interior cavity where the flowable shaving aid material is stored.

According to an aspect of the present invention, a shaving apparatus includes a razor cartridge. The razor cartridge includes one or more razor blades mounted to the housing adjacent at least one of the ports disposed within the houisng.

An advantage of the present invention shaving apparatus is that flowable shaving aid can be dispensed from the shaving apparatus by pressing a button on the shaving apparatus handle.

These and other objects, features, and advantages of the present invention will become apparent in light of the detailed description of the present invention.

DETAILED DESCRIPTION OF THE INVENTION

Figure 1:
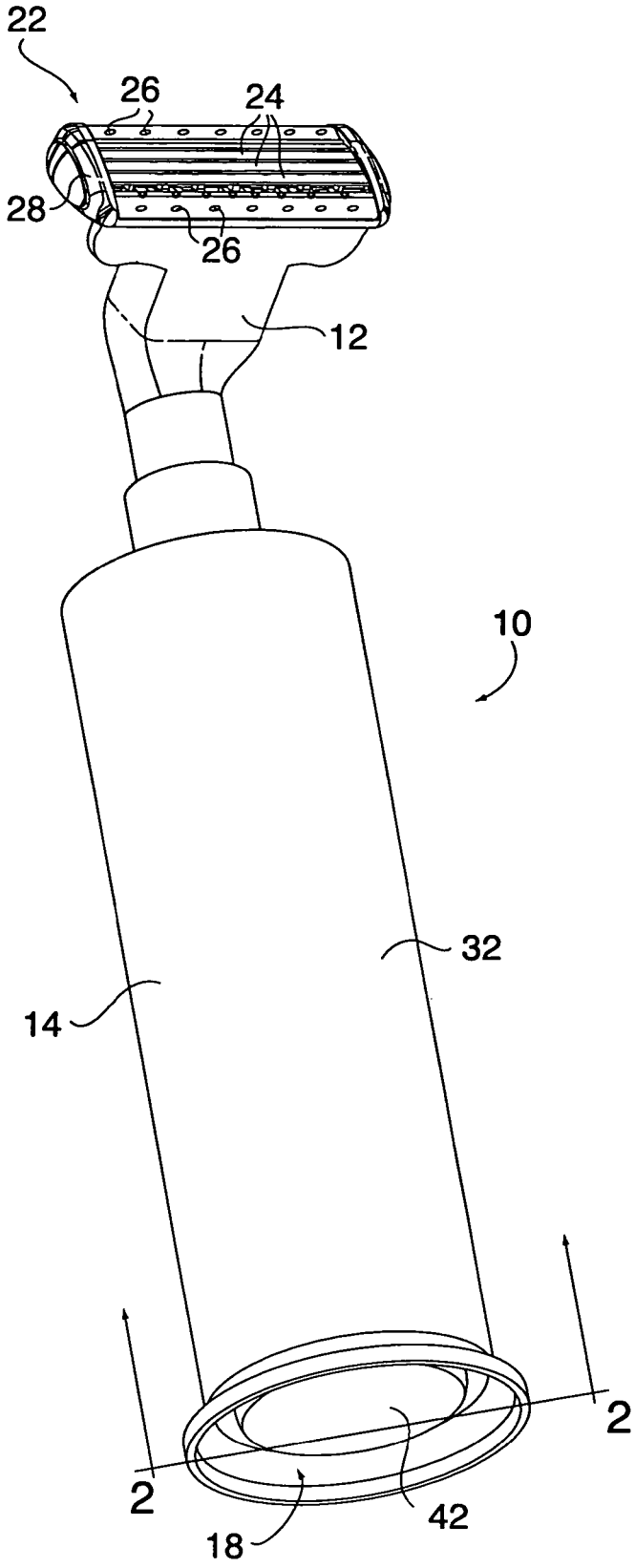
FIG. 1 is a perspective view of one embodiment of a shaving apparatus of the present invention.
Figure 2:
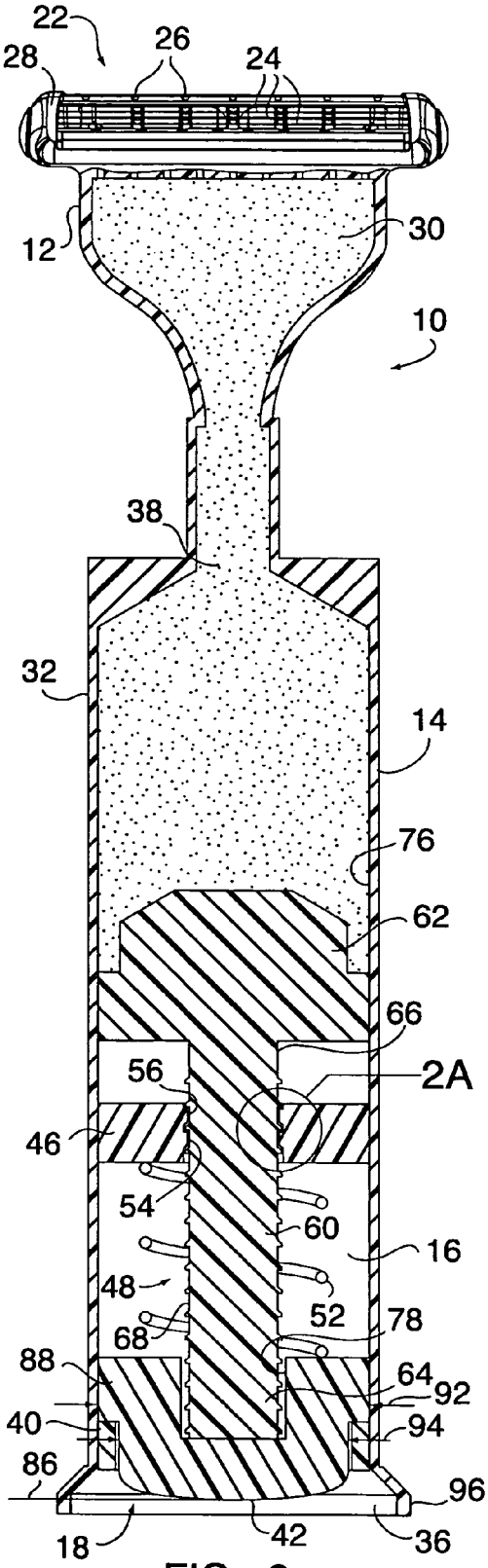
FIG. 2 is a sectional view of one embodiment of the present invention across line 2—2 of FIG. 1.

Referring to FIGS. 1 and 2, a shaving apparatus 10 includes a housing 12 and a handle 14. The handle 14 includes an interior cavity 16 and an actuator 18.

In some embodiments, the shaving apparatus further includes a razor cartridge 22 that has one or more razor blades 24. The razor cartridge is pivotally or fixedly attached to the shaving apparatus 10. A variety of different razor cartridges 22 can be used with the present shaving apparatus 10, including those that are permanently mounted to the handle 14, as well as those that are intended to be disposable. The present shaving apparatus 10 is not limited to any particular razor cartridge 22. In some embodiments, the shaving apparatus handle 10 and razor cartridge are attached to one another in such a manner that the two are not intended to be separated during normal use. In those embodiments, the shaving apparatus 10 may be used for a time and thereafter the shaving apparatus handle 10 and razor cartridge 22 are intended to be disposed of together.

The housing 12 includes one or more ports 26 and is positioned adjacent the razor cartridge 22. The housing 12 includes an exterior surface 28 that may be smooth, or textured. In some embodiments, the housing 12 substantially surrounds the razor cartridge 22. The housing 12 is fixedly or pivotally attached to the handle 14.

The one or more ports 26 (as shown in FIG. 1) in the housing 12 are in fluid communication with at least a portion of the interior cavity 16 (discussed in greater detail infra.) of the handle 14. Each port 26 is operable to allow a flowable shaving aid material 30 (also discussed infra.) to pass therethrough. Typically, the size of each port 26 is determined by the type of flowable shaving aid material 30 disposed in the interior cavity 16, the number of ports 26 located on the housing 12, and the desired rate at which the flowable shaving aid material 30 is dispensed. The one or more ports 26 may be fore and/or aft the razor cartridge 22 during normal use. A port 26 disposed "fore" of the razor cartridge is encountered before the razor cartridge during a stroke of the shaving apparatus. A port 26 disposed "aft" of the razor cartridge is encountered after the razor cartridge during a stroke of the shaving apparatus. In some embodiments, one port 26 may substantially surround the razor cartridge 22. In these embodiments, the contents (i.e., the flowable shaving aid material 30) of the interior cavity 16 will, in part, exit through the razor cartridge 22.

The handle 14 includes an exterior grip portion 32 that may be of any practical shape and size. Preferably, the exterior grip portion 32 is ergonomically contoured to allow it to be gripped comfortably by the user.

The interior cavity 16 includes a first end 36 and a second end 38 lengthwise along the handle 14. In the embodiments of FIGS. 1–4, the interior cavity 16 has a cross-sectional shape that accommodates the actuator as will be described below. The embodiments shown in FIGS. 1–4 have a cylindrical cross-sectional shape. Other cavity cross-sectional shapes may be used alternatively. The interior cavity 16 is sized to accommodate at least the actuator 18 and a quantity of flowable shaving aid material 30. In some embodiments, the interior cavity 16 includes a button retainer 40 near the first end 36 to prevent the button 42 (discussed infra.) from being undesirably expelled from the interior cavity 16.

Figure 3:
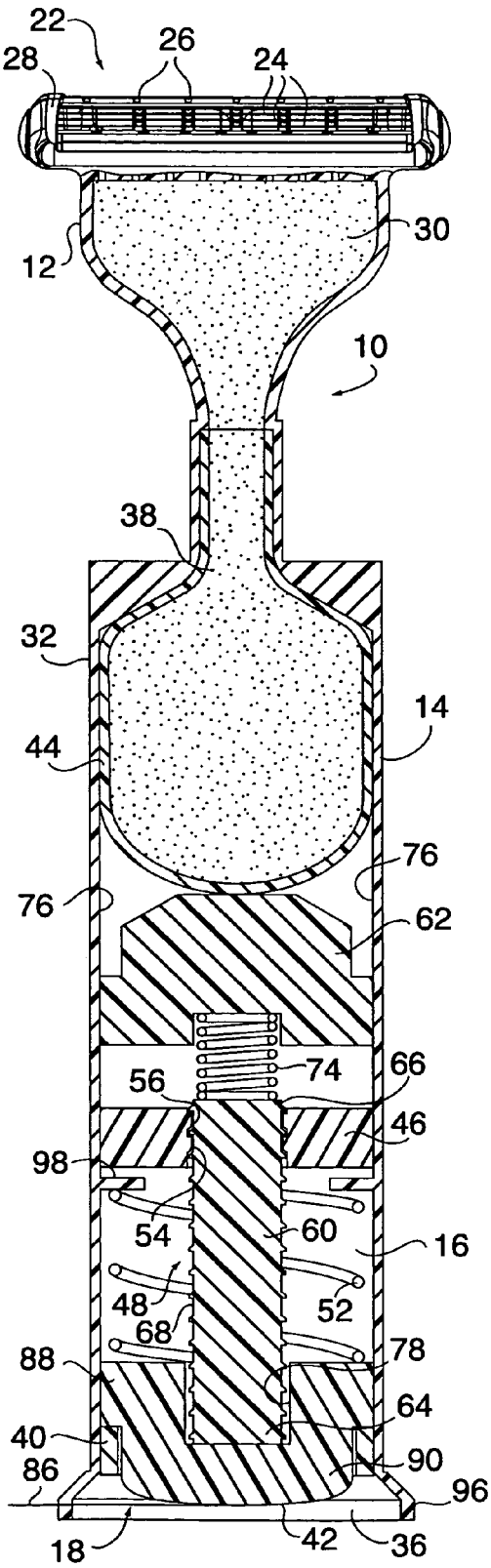
FIG. 3 is a sectional view of another embodiment of the present invention.

Referring to FIG. 3, in some embodiments, a flexible bladder 44 is disposed in the interior cavity 16 of the handle 14 such that the one or more ports 26 are in fluid communication with the contents of the flexible bladder 44. The flexible bladder 44, and/or the interior cavity 16, as shown in FIG. 2, are operable to store a flowable shaving aid material 30. It is also preferable that the flexible bladder 44, when filled, has a shape that is complimentary to the interior cavity 16 of the handle 14.

As shown in FIGS. 2 and 3, the interior cavity 16 (with or without a flexible bladder 44) is operable to store a flowable shaving aid material 30 between the actuator 18 (discussed infra) and the one or more ports 26. Flowable shaving aid materials 30 include, but are not limited to, lubricating agents, drag reducing agents, depilatory agents, cleaning agents, medicinal agents, and the like, that enhance the shaving process. Common forms of flowable shaving aid materials 30 include liquids, creams, and gels.

Figure 4:
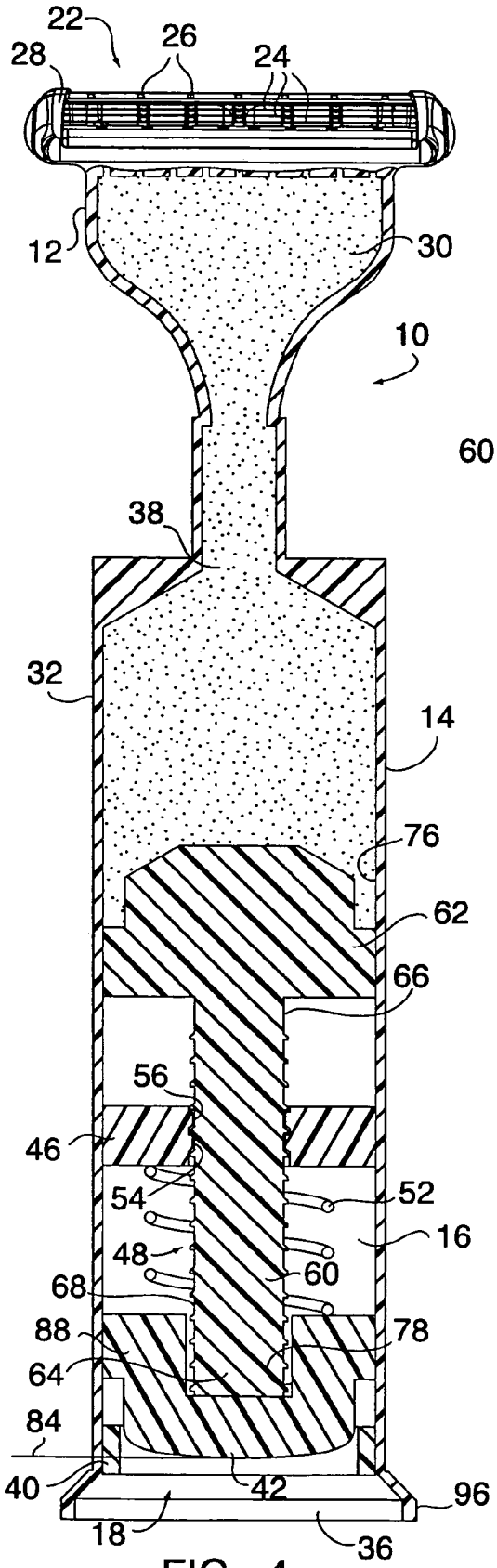
FIG. 4 is a sectional view depicting the embodiment of FIG. 1 with a depressed button.

Referring to FIGS. 2–4, the actuator 18 is disposed within the handle 14 and is selectively operable to decrease the volume of the interior cavity 16 between the piston head 62 (discussed infra.) and the one or more ports 26. In embodiments utilizing a flexible bladder 44, the reduction in volume of the interior cavity 16 will, in turn, reduce the volume of the flexible bladder 44. The actuator 18 includes a ratchet mechanism 46, a piston 48, a button 42, and a button spring 52.

Figure 2A:
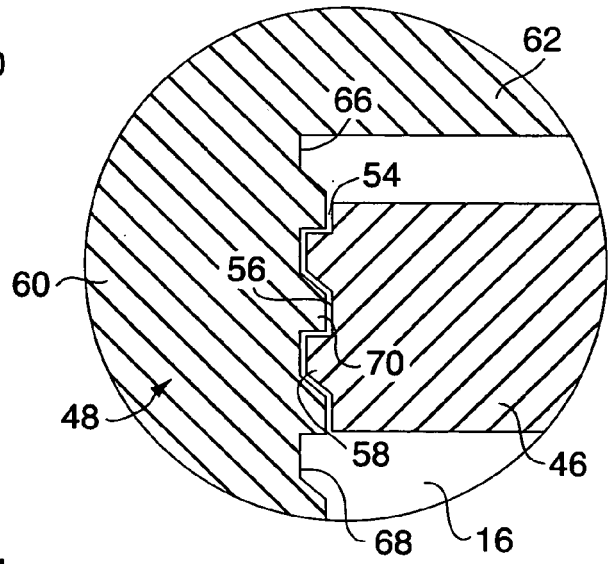
FIG. 2A is a blown up view of Area 2A of FIG. 2.

Referring to FIGS. 2 and 2A, the ratchet mechanism 46 is mounted in the interior cavity 16 between the first end 36 and the second end 38 and includes an aperture 54 having an inner wall 56. The ratchet mechanism 46 is operable to advance the piston 48 uni-directionally towards the second end 38 of the interior cavity 16 through a series of distinct positions during normal use. In some embodiments, the inner wall 56 of the aperture 54 includes at least one first ratchet element 58. For example, the embodiment shown in FIG. 2A, indicates one acceptable type of ratchet element, often referred to as a ratchet pall.

Referring to FIGS. 2 and 2A, the piston 48 includes a piston body 60 and a piston head 62. The piston body 60 includes a first end 64 and a second end 66. The piston head 62 is coupled to the second end 66 of the piston body 60 and, in some embodiments, may be integral with the piston body 60. The piston head 62 is typically shaped to mate with the shape of the interior cavity 16; e.g., if the interior cavity 16 has a circular cross-sectional shape, then the piston head 62 has a circular cross-sectional shape. A variety of mating shapes can be used and the interior cavity 16 and the piston head 62 are not limited to any particular shape. The piston 48 is operable to be selectively moved uni-directionally towards the second end 38 of the interior cavity 16 through a series of distinct positions by the button 42 and the ratchet mechanism 46 working in concert. In some embodiments, at least a portion of the outside surface 68 of the piston body 60 includes a plurality of second ratchet elements 70 that are complimentary to the first ratchet elements 58 on the inner wall 56 of the aperture 54, as shown in FIG. 2A. Together, the first ratchet element(s) 58 and the second ratchet elements 70 enable the piston 48 to be selectively moved by a user towards the second end 38 of interior cavity 16 relative to the ratchet mechanism 46.

Referring to FIGS. 2 and 3, the piston head 62 is coupled to the second end 66 of the piston body 60. In some embodiments, such as the embodiment shown in FIG. 3, the piston 48 and the piston head 62 are not fixedly attached, but rather are coupled together by a piston spring 74. As shown in FIG. 3, the piston spring 74 is a compression spring that is operable to press against the piston head 62 when the button 42 (discussed infra.) is depressed and the piston body 60 is forced towards the second end 38 of the interior cavity 16. In some embodiments, particularly those embodiments that do not utilize a flexible bladder 44, the piston head 62 forms a slidable seal with an inside wall 76 of the interior cavity 16, thereby preventing the flowable shaving aid material 30 from flowing into the actuator 18. Preferably, the piston 48 is disposed in the interior cavity 16 such that the piston head 62 is positioned between the ratchet mechanism 46 and the second end 38 of the interior cavity 16 and the piston body 60 passes through the aperture 54 in the ratchet mechanism 46. The first end of the piston body 60 is at least partially inserted into an interior cavity 78 in the button 42.

Referring to FIGS. 2, 3 and 4, the button 42 is movably coupled to the first end 36 of the interior cavity 78. In some embodiments, the button 42 is integral with the piston body 60. The button 42 is operable to be selectively moved between a depressed position 84 (as shown in FIG. 4), and a rest position 86 (as shown in FIGS. 2 and 3). In some embodiments, the button 42 includes a base 88 and a top portion 90. Typically, the top portion 90 of the button 42 is sized such that the top portion 90 of the button 42 extends through the button retainer 40, to a position where it is user-accessible. However, the base 88 is typically sized such that it will not pass through the button retainer 40 during normal use, thereby preventing the button 42 from undesirably being expelled from the interior cavity 16 during normal use. For example, in the embodiment in FIG. 2, the base 88 is an annular projection having a larger outer diameter 92 than an inner diameter 94 of the button retainer 40 shown.

Referring to FIGS. 2–4, in some embodiments, at least a portion of the button 42 is approximately the same size and shape as the interior cavity 16 of the handle 14 in order to prevent the button 42 from undesirably angling, or tilting when moving within the interior cavity 16. In the embodiment shown in FIGS. 1–3, the handle 14 includes a button guard 96 that extends a distance from the handle 14 in order to provide the button 42 with additional protection.

Referring to FIGS. 2 and 4, the button spring 52 is a coil spring disposed within the interior cavity 16 of the handle between the button 42 and the ratchet mechanism 46. The button spring 52 is not, however, limited to a coil-type spring and may alternatively assume other biasing forms; e.g., leaf spring, elastic member, etc. Alternatively, as shown, for example, in FIG. 3, the button spring 52 may be disposed between the button 42 and a protrusion 98 in the interior cavity 16. The button spring 52 is operable to provide a constant force against the button 42 generally in the direction of the first end 36 of the interior cavity 16.

In operation, the user depresses the button 42, thereby causing the piston body 60 and, accordingly, the piston head 62 to move toward the second end 38 of the interior cavity 16. The first ratchet elements 58 on the inner walls 56 of the aperture 54 of the ratchet mechanism 46 allow the second ratchet elements 70 on the piston body 60 to pass thereby. As the piston body 60 travels towards the second end 38 of the interior cavity 16, the volume of the portion of the interior cavity 16 in which the flowable shaving aid 30 is stored is reduced. The flowable shaving aid 30 is, therefore, forced from the interior cavity 16, to the one or more ports 26 where it is dispensed adjacent the razor cartridge 22. When the pressure on the button 42 is released, the button 42 then returns to the rest position 86 under the force of the button spring 52. However, the first ratchet elements 58 on the ratchet mechanism 46 engage the second ratchet elements 70 un the piston body 60, thereby preventing the piston 48 from moving towards the first end 36 of the interior cavity 16. The flowable shaving aid material 30 is then applied to the surface being shaved adjacent the razor cartridge 22 during shaving.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. A shaving apparatus handle, comprising:

an interior cavity operable to store flowable shaving aid material, the interior cavity having a first end and a second end lengthwise;

a housing having one or more ports mounted on the handle, the one or more ports being in fluid communication with at least a portion of the interior cavity;

an actuator disposed within the interior cavity, the actuator including a ratchet mechanism mounted between the first and second ends of the interior cavity, a button movably positioned between the ratchet mechanism and the first end of the interior cavity, a piston having a piston head coupled to a piston body, and a button spring operable to bias the button towards the first end of the interior cavity; and wherein the ratchet mechanism and the button are operable to work in concert to move the piston uni-directionally toward the second end of the interior cavity through a series of distinct positions.

2. The shaving apparatus handle of claim 1, wherein the interior cavity has a cross-sectional shape that mates with a cross-sectional shape of the piston head.

3. The shaving apparatus handle of claim 1, wherein the interior cavity includes a button retainer operable to prevent the button from being expelled from the interior cavity.

4. The shaving apparatus handle of claim 1, wherein a flexible bladder operable to store a flowable shaving aid material is disposed in the interior cavity.

5. The shaving apparatus handle of claim 4, wherein the flexible bladder, when filled, has a shape that is complimentary to the interior cavity.

6. The shaving apparatus handle of claim 1, wherein the actuator is operable to decrease the volume of the interior cavity between the piston head and the second end of the interior cavity.

7. The shaving apparatus handle of claim 1, wherein the ratchet mechanism includes an aperture, and at least one first ratchet element disposed within the aperture; and at least a portion of an outer surface of the piston body includes a plurality of second complimentary ratchet elements, the first and second ratchet elements being complimentary.

8. The shaving apparatus handle of claim 7, wherein the plurality of second ratchet elements form notches.

9. The shaving apparatus handle of claim 1, wherein the ratchet mechanism includes an aperture;

the button includes an interior cavity; and the piston is positioned in the interior cavity such that the piston head is positioned between the ratchet mechanism and the second end of the interior cavity, the piston body passes through the aperture in the ratchet mechanism and a first end of the piston body is at least partially inserted into the interior cavity of the button.

10. The shaving apparatus handle of claim 9, wherein the piston head is coupled to a second end of the piston body by a piston spring.

11. The shaving apparatus handle of claim 1, further comprising a protrusion in the interior cavity between the ratchet mechanism and the button; and wherein the button spring is disposed between disposed between the protrusion and the button.

12. A shaving apparatus, comprising:

a handle having an interior cavity operable to store flowable shaving aid material, the interior cavity having a first end and a second end lengthwise;

a housing having one or more ports mounted on the handle;

a razor cartridge having one or more razor blades mounted to the housing adjacent at least one port;

an actuator disposed within the interior cavity, the actuator including a ratchet mechanism mounted between the first and second ends of the interior cavity, a button movably positioned between the ratchet mechanism and the first end of the interior cavity, a piston having a piston head coupled to a piston body, and a button spring operable to bias the button towards the first end of the interior cavity; and wherein the ratchet mechanism and the button are operable to work in concert to move the piston uni-directionally toward the second end of the interior cavity through a series of distinct positions.

13. The shaving apparatus of claim 12, wherein the interior cavity has a cross-sectional shape that mates with a cross-sectional shape of the piston bead.

14. The shaving apparatus of claim 12, wherein the interior cavity includes a button retainer operable to prevent the button from being expelled from the interior cavity.

15. The shaving apparatus of claim 12, wherein a flexible bladder operable to store a flowable shaving aid material is disposed in the interior cavity of the handle.

16. The shaving apparatus of claim 15, wherein the flexible bladder, when filled, has a shape that is complimentary to the interior cavity of the handle.

17. The shaving apparatus of claim 12, wherein the actuator is operable to decrease the volume of the interior cavity between the piston head and the second end of the interior cavity.

18. The shaving apparatus of claim 12, wherein the ratchet mechanism includes an aperture and at least one first ratchet element disposed within the aperture; and at least a portion of an outer surface of the piston body includes a plurality of second complimentary ratchet elements, the first and second ratchet elements being complimentary.

19. The shaving apparatus of claim 18, wherein the plurality of second ratchet elements form notches.

20. The shaving apparatus of claim 12, wherein the ratchet mechanism includes an aperture;

the button includes an interior cavity; and the piston is positioned in the interior cavity such that the piston head is positioned between the ratchet mechanism and the second end of the interior cavity, the piston body passes through the aperture in the ratchet mechanism and a first end of the piston body is at least partially inserted into the interior cavity of the button.

21. The shaving apparatus of claim 20, wherein the piston head is coupled to a second end of the piston body by a piston spring.

22. The shaving apparatus of claim 12, further comprising a protrusion in the interior cavity between the ratchet mechanism and the button; and wherein the button spring is disposed between the protrusion and the button.

* * * * *

UNITED STATES PATENT AND TRADEMARK OFFICE

CERTIFICATE OF CORRECTION

PATENT NO. : 6,910,274 B1
DATED : June 28, 2005
INVENTOR(S) : Andrew Pennella et al.

It is certified that error appears in the above-identified patent and that said Letters Patent is hereby corrected as shown below:

Column 6,
Lines 1-2, delete the second occurrence of "disposed between".

Signed and Sealed this

Twenty-third Day of August, 2005

JON W. DUDAS
*Director of the United States Patent and Trademark Office*